US005790963A

United States Patent [19]

Welham

[11] Patent Number: 5,790,963

[45] Date of Patent: Aug. 4, 1998

[54] METHOD OF DISPOSING OF EXPLOSIVE MUNITIONS

[75] Inventor: Christopher John Welham, Ingatestone, England

[73] Assignee: Disarmco Limited, Essex, United Kingdom

[21] Appl. No.: 818,639

[22] Filed: Mar. 14, 1997

[51] Int. Cl.[6] ..... A62D 3/00

[52] U.S. Cl. ..... 588/202

[58] Field of Search ..... 588/202; 110/237

[56] References Cited

U.S. PATENT DOCUMENTS 5,431,100 7/1995 Snyder ..... 102/202.6

5,458,071 10/1995 Tadmor et al. ..... 110/237

5,574,203 11/1996 Noel et al. ..... 588/203

5,582,119 12/1996 Barkdoll ..... 110/346

*Primary Examiner*—Ngoclan Mai

*Attorney, Agent, or Firm*—Smith-Hill and Bedell

[57] ABSTRACT

A method is described for disposing of an explosive munition consisting of a mass of explosive contained in a casing, which method comprises locally heating a region of the casing to a temperature below the melting point of the material of the casing but sufficiently hi to initiate combustion of the explosive mass.

The heat is preferably applied by the use of a thermit which burns at a lower temperature than conventional thermits an which uses as a combustible powder a mixture of aluminum iron oxide and a moderator, such as silica sand.

8 Claims, 1 Drawing Sheet

METHOD OF DISPOSING OF EXPLOSIVE MUNITIONS

FIELD OF THE INVENTION

The present invention relater to a method of disposing of explosive munitions.

BACKGROUND OF THE INVENTION

A thermit is a device for used to generate a large amount of heat in a short time. Conventionally, it comprises a powder containing a mixture of aluminum and iron oxide (millscale) which when ignited burns at a temperature of around 2500° C. The ignition is carried out by an electrical detonator or fusehead surrounded by a mixture of aluminum powder and. barium peroxide. This latter mixture explodes ad generates sufficient beat to initiate the exotheric reaction between the aluminum and the iron oxide.

Such devices are know and have been used in welding, for example in joining railway lines. They have also found use in bomb disposal.

A typical bomb is shown schematically in section in FIG. 1 of the accompanying drawings. The bomb consists of a steel casing 10 filled with an explosive 12. At one end of the bomb, there is a cylindrical detonator housing 14 which is screwed into the casing and which in turn receives a detonator (not shown). In order to dispose of such a bomb, the detonator is removed and a thermit 16 is placed in the detonator housing while the bomb is supported in an inclined position using a block 18. The thermit 16 is ignited and. burns very rapidly to melt the detonator housing 14 and penetrate into the explosive 12 which is then ignited. Pressure build up in the box casing should be prevented by the hole in t housing 14 and the explosive burns away—without the bomb being set off.

In practice, unfortunately, a significant portion of the bombs do explode. One reason for this is that the thermit 16 slides& deep into the bomb and does not merely burn the explosive progressively starting from the opening which it forms in the detonator housing 14. Once embedded deep in the explosive, too much of the explosive is set alight and the reaction products cannot escape sufficiently rapidly to avoid a significant pressure build up inside the bomb. Instead of a progressive burning of the explosive, a violent explosion then occurs.

OBJECT OF THE INVENTION

The present invention therefore seeks to provide a method that enables safer disposal of munitions.

SUMMARY OF THE INVENTION

According to the present invention, there is provided a method of disposing of an explosive munition comprising a mass of explosive contained in a casing, which method comprises locally heating a region of the casing to a temperature below the melting point of the material of the casing but sufficiently high to initiate combustion of the explosive mass.

The invention differs from the prior art approach in that the local heating does not itself cause melting of a part of the casing but it is the localised burning of the explosive itself which meets the casing.

A thermit may be used to generate a temperature not of 2500° C. but one of typically 250° C. This temperature is enough to ignite the explosive mass in the immediate vicinity of the thermit and once this has occurred, the heat given off by the explosive melts the detonator housing and relieves the pressure in the bomb casing.

The method ensures that the explosive burns progressively starting near the detonator housing.

Preferably, the local heating is effected by the use of a thermit containing aluminum powder, iron oxide and a moderator powder for reducing the temperature at which the powder burns.

The moderator may suitably be silica sand but other materials may be used.

The thermit should burn at a temperature below the melting point of the detonator casing but higher than the ignition temperature of the explosive in the munition. In practice, a temperature of 250° C. is preferred for safety.

The grain size and relative quantities of the ingredients are important for controlled burning. In the preferred embodiment of the invention, the aluminum powder and the silica sand have an 80 mesh ESS particle size and the iron oxide is dry roasted and has an oxygen content of approximately 16% by 18% by weight.

For a thermit designed to burn at 250° C., the weights of the ingredients should be in the ratios of 75 of iron oxide to 25 of aluminum to 40 silica sand.

Though the thermit will burn steadily at a low temperature a higher temperature is required for its ignition. A conventional starter comprising a fusehead detonator surrounded by a mixture of barium peroxide and aluminum may be need to initiate ignition, the starter being contained within a separate container or membrane.

Whereas conventional thermits are packaged in rigid metal tubes, in a further aspect of the invention, the powder is packed in a sealed flexible bags such as a plastics bag. This offers the advantage of permitting the base of the detonator housing to be heated more evenly-and directly.

BRIEF DESCRIPTION OF THE DRAWINGS

The invention will now be described further, by way of example, with reference to the accompanying drawings, in which.

DESCRIPTION OF THE PREFERRED EMBODIMENT

Figure 2:
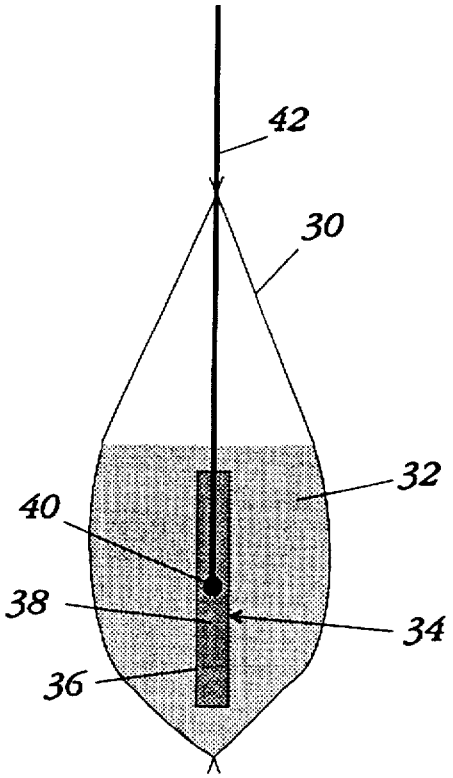
FIG. 2 is a section through a thermit of the invention.

In FIG. 2, a thermit comprises a plastics bag 30 filled with a powder 32 which will burns at around 250° C. when ignited. This powder consists of a mixture of aluminum, iron oxide (millscale) and silica sand present in the ratios of 75:25:44. The silica sand, which acts as a moderator has an 80 mesh particle size and the millscale is dry roasted and has an oxygen content of approximately 16% to 18% by weight.

A higher temperature is required to ignite the mixture and this is generated by a starter 34 which comprises a fusehead detonator 40 surrounded by a powder 38 consisting of a mixture of barium peroxide and aluminum, tee powder 32 and the detonator 40 beg contain within an envelope 36 which can conveniently be made of paper. The wire leads 42 to the fusehead detonator 40 passes out of the envelope 36 of the starter 34 and the plastics bag 30, the latter being sealed around the leads 42.

Figure 1:
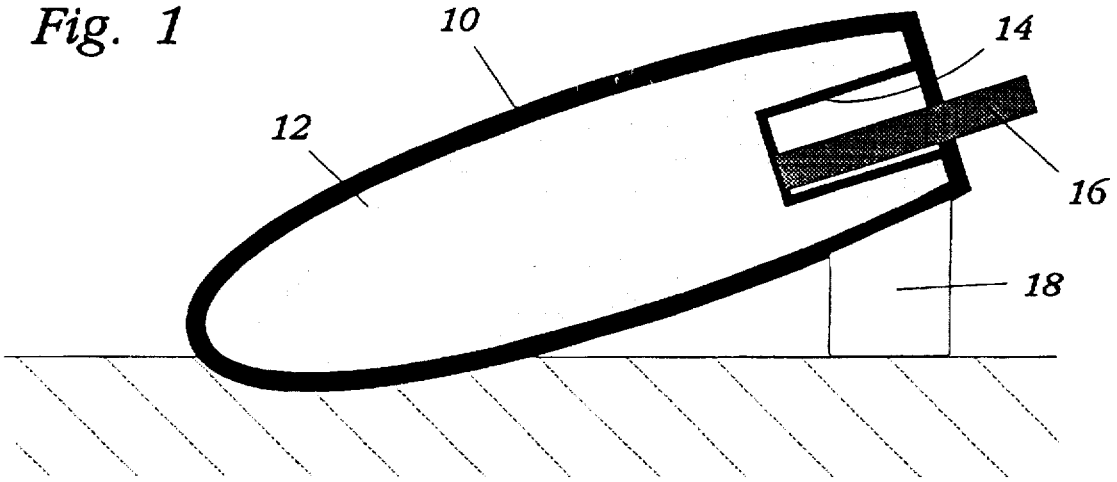
FIG. 1 is, as earlier described, a section through a bomb during its disposal.

In use of this thermit for bomb disposal, it is used in the same way as the thermit 16 of FIG. 1 but because the plastics bag 30 is flexible it can be pressed down to conform to the shape of the detonator housing 14. When it is ignited, it burns at around 250° C. and ignites the explosive 12 in the immediate vicinity of the detonator housing 14. The heat generated by the burning of the explosive melts a hole in the detonator housing 14 to allow the escape of combustion gases.

Thus, unlike the prior art thermit, in the present invention combustion of the explosive 12 always starts near the detonator housing 14 and progresses towards the closed end of the bomb 10, thereby significantly reducing the risk of explosion.

I claim:

1. A method of disposing of an explosive munition comprising a mass of explosive contained in a casing, which method comprises locally heating a region of the casing to a temperature below the melting point of the material of the casing but sufficiently high to initiate combustion of the explosive mass.

2. A method as claimed in claim 1, the casing is heated by means or a thermit containing aluminum powder, iron oxide and a moderator powder for reducing the temperature at which the powder burns.

3. A method as claimed in claim 2, wherein the moderator is silica sand.

4. A method as claimed in claim 3, wherein the silica sand has a particle size of 80 mesh BSS.

5. A method as claimed in claim 2, wherein the iron oxide is dry roasted and has an oxygen content of between approximately 16% and 18% by weight.

6. A method as claimed in claim 2, wherein the aluminum, iron oxide and silica sand are present in the ratio of 75:25:40.

7. A method as claimed in claim 2, wherein the thermit has a flexible outer casing containing the powder mixture.

8. A method as claimed in claim 2, wherein the thermit has disposed therein a starter comprising a fusehead detonator surrounded by a powder comprising aluminum and barium peroxide.

* * * * *